US007820302B2

(12) United States Patent
Krettenauer

(10) Patent No.: US 7,820,302 B2
(45) Date of Patent: Oct. 26, 2010

(54) PLANAR METAL ELEMENT AND PROFILE ELEMENT

(75) Inventor: Kilian Krettenauer, Gaggenau (DE)

(73) Assignee: Protektorwerk Florenz Maisch GmbH & Co. KG, Gaggenau (DE)

( * ) Notice: Subject to any disclaimer, the term of this patent is extended or adjusted under 35 U.S.C. 154(b) by 1148 days.

(21) Appl. No.: 10/538,381

(22) PCT Filed: Nov. 25, 2003

(86) PCT No.: PCT/EP03/13249

§ 371 (c)(1),
(2), (4) Date: May 3, 2006

(87) PCT Pub. No.: WO2004/055289

PCT Pub. Date: Jul. 1, 2004

(65) Prior Publication Data

US 2006/0246312 A1 Nov. 2, 2006

(30) Foreign Application Priority Data

Dec. 18, 2002 (DE) ..... 102 59 307

(51) Int. Cl.
*E04C 2/42* (2006.01)
*E04C 2/08* (2006.01)
*E04C 3/08* (2006.01)

(52) U.S. Cl. ..... 428/595; 428/697; 52/671; 52/675; 29/896.6

(58) Field of Classification Search ..... 52/634, 52/635, 636, 670, 671, 673, 675; 428/595, 428/597; 29/896.6
See application file for complete search history.

(56) References Cited

U.S. PATENT DOCUMENTS 181,850 A * 9/1876 Kensett ..... 52/674
438,327 A * 10/1890 Sagendorph ..... 52/674
1,113,195 A * 10/1914 Clark ..... 52/671
3,008,551 A * 11/1961 Cole ..... 428/132

(Continued)

FOREIGN PATENT DOCUMENTS

FR 2518611 6/1983

(Continued)

*Primary Examiner*—John J Zimmerman
(74) *Attorney, Agent, or Firm*—Gifford, Krass, Sprinkle, Anderson & Citkowski, P.C.

(57) ABSTRACT

An areal metal element is described having a surface which extends from a first outside edge to a second outside edge lying opposite the first out-side edge. The region of the metal element adjoining the first outside edge forms a first edge region and the region of the metal element adjoining the second outside edge forms a second side region. Both side regions are connected to one another by a central region lying therebetween, with at least one completely bordered aperture being formed at least in one of the side regions, with its border being formed in one part by this side region and in another part by the central region. The central region includes at least two sections which each consist of two outwardly disposed part sections and a central part section lying therebetween. The outwardly disposed part sections are folded over with respect to the central section to produce the aperture. The sections form part of the border of the aperture and the central region including the sections is made in one piece with the two side regions of the metal element.

60 Claims, 11 Drawing Sheets

U.S. PATENT DOCUMENTS

| | | | | | |
|---|---|---|---|---|---|
| 3,111,204 | A | | 11/1963 | Phare | |
| 3,287,873 | A | | 11/1966 | McDill | |
| 4,545,170 | A | * | 10/1985 | Shirey | 52/670 |
| 4,559,752 | A | | 12/1985 | Kieffer | |
| 5,060,352 | A | | 10/1991 | Barker | |
| 5,081,814 | A | | 1/1992 | Singletary et al. | |

FOREIGN PATENT DOCUMENTS

| | | |
|---|---|---|
| NZ | 231531 | 8/1992 |
| WO | WO 86/06431 | 11/1986 |

* cited by examiner

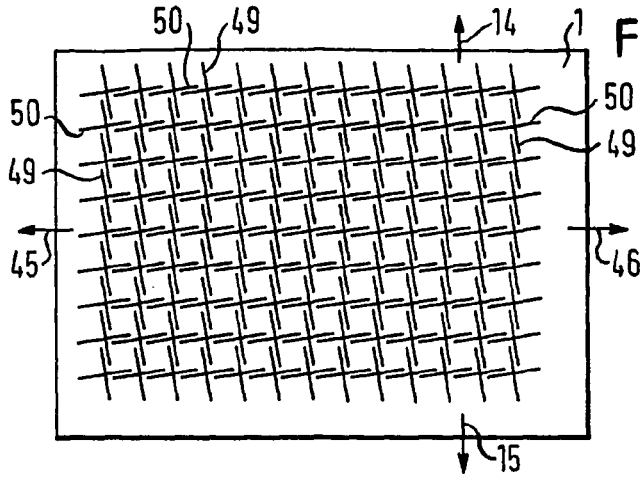
Fig. 18
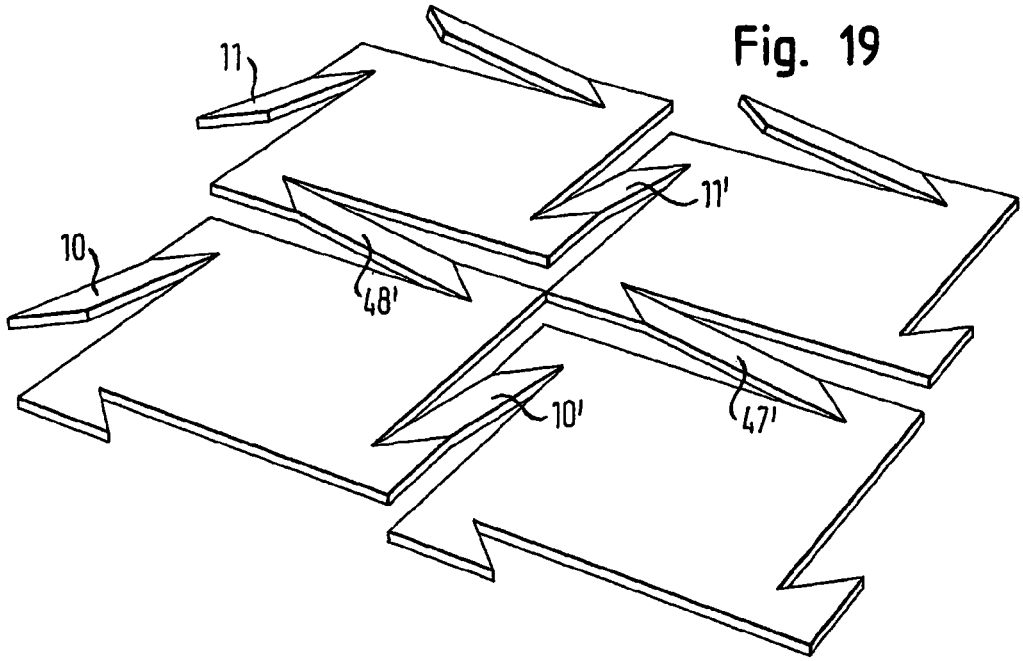
Fig. 19
Fig. 20
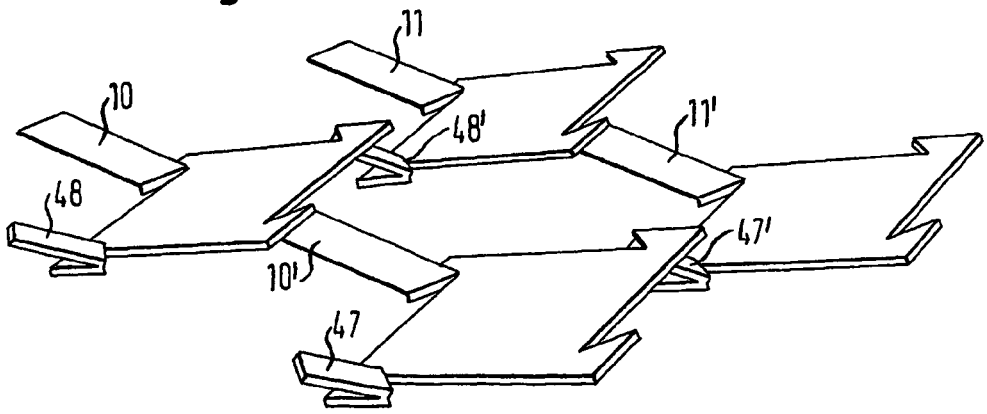

PLANAR METAL ELEMENT AND PROFILE ELEMENT

BACKGROUND OF THE INVENTION

1. Field of the Invention

The present relation relates to an areal metal element having a surface which extends from a first outside edge to a second outside edge lying opposite the first outside edge, with the region of the metal element adjoining the first outside edge forming a first side region and the region of the metal element adjoining the second outer edge forming a second side region, both said side regions being connected to one another by a central region lying between them, and with at least one completely bordered aperture being formed in at least one of the side regions, with its border being formed in one part by said side region and in another part by the central region. The invention is furthermore directed to a section element which is produced from such an areal metal element.

2. Description of Related Art

Areal metal elements of the kind initially named are used, for example, in the production of sections. Such sections can, for example, be stand sections such as are in particular used in interior work for the fastening of plate-like elements, or also corner sections which are used for the protection of corners, usually under plaster. It is in particular necessary for such plaster sections that said sections have material apertures so that the plaster can pass through the sections and so that a fixing of the sections is thus ensured.

As a rule, such apertures are produced by punching procedures such that the parts punched out form waste. This is disadvantageous, on the one hand, since these parts either have to be disposed of or made available for recycling. On the other hand, a substantial disadvantage lies in the fact that the costs in the production of a corresponding section are determined to a predominant degree by the material costs. A punching out of part surfaces is thus uneconomic, in particular when the punched out part surfaces have to be disposed of as waste.

To avoid this disadvantage, it is already known to produce bored sections from expanded metal. In the use of expanded metal, slots are cut into the metal sheet used for the production of the sections such that the metal sheet is subsequently pulled apart at two opposite sides, with the slots expanding to form the desired apertures. The material lying between the apertures is stretched or expanded in this process, whereby the desired deformation and, associated therewith, a widening of the material takes place. However, strains arise in the material by the expanding of the material which can result in an unwanted weakening. The bending stiffness of expanded metal is also reduced so that expanded metal cannot be used in many areas. Finally, the widenings of the material achieved with the expanded metal are often not sufficient.

SUMMARY OF THE INVENTION

It is an object of the present invention to develop an areal metal element of the kind initially named such that the apertures are formed without material loss, with at the same time substantially no strains being present within the material. Furthermore, the metal element should have a high stiffness and a large widening of the material or extension of the area should be possible with respect to the starting material.

Starting from a metal element of the kind initially named, this object is satisfied in accordance with the invention in that the central region includes at least two sections which each consist of two outwardly disposed part sections and one center part section lying between them, in that the outwardly disposed part sections are folded over with respect to the central part section to produce the aperture, in that the sections form part of the border of the aperture, and in that the central region including the sections is formed in one piece with the two side regions of the metal element.

In accordance with the invention, the apertures are thus not produced by an expansion procedure in the areal metal element, but by a folding over of part sections such that a stretching or an expansion within the metal element, such as is present in expanded metal, is avoided. The folded over part sections are arranged such that an unfolding of the two outer side regions of the metal element apart from one another takes place during the workstep, whereby the desired widening of the material or expansion is achieved. At the same time, it is ensured by the folding over and by the formation in one piece of the metal element that the apertures in the metal element can be produced in a one-piece production process and the desired stiffness and stability are ensured.

In accordance with an advantageous embodiment of the invention, the outwardly disposed part sections extend in opposite senses to one another, that is are folded over in directions opposite to one another. One of the outwardly disposed part sections is in particular folded over toward the upper side of the central part section and the other outwardly disposed part section is folded over toward the lower side of the central part section. The part sections can be folded over either facing one another or facing away from one another.

It is generally also possible for the outwardly disposed part sections to be folded in the same sense with respect to one another, that is facing in the same direction. Both outwardly disposed part sections are in particular folded over toward the same side in this process, that is either both are folded over toward the upper side or both are folded over toward the lower side of the central part section.

In accordance with a further advantageous embodiment of the invention, a plurality of apertures are formed at least in one of the side regions. This is in particular sensible when the areal metal element has an elongated design extending in the direction of the outer edges, since a corresponding widening of the metal element over its total length is only possible by the apertures. A plurality of apertures are advantageously formed in each of the side regions. These apertures are preferably spread alternately in both side regions, with preferably the folded over, outwardly disposed part sections of a respective section simultaneously being associated with a respective aperture of the first side region and with an subsequent aperture of the second side region.

In accordance with a further advantageous embodiment of the invention, additional apertures are formed in the central region. The apertures formed in the central region are advantageously formed in correspondence with the apertures formed in the side regions. It is thus possible to achieve an additional widening of the metal element in that a plurality of sections folded over in accordance with the invention are provided which lie in series between the outside edges.

A section is advantageously formed as a web with side edges extending parallel to one another. The side edges of the section can, however, generally also extend obliquely with respect to one another or, for example, also be curved, as long as the turning over of the part sections in accordance with the invention is not prevented thereby. Surfaces deviating from the web shape, for example laterally projecting surfaces, can in particular be provided at the ends of the sections.

In accordance with a further preferred embodiment of the invention, the side edges and the webs extend parallel to one another or obliquely to one another. The geometry is also only restricted in this process in that a folding over of the outwardly disposed part sections, and thus turning over of the two side regions apart from one another, is not hindered.

It is achieved by the invention that the spacing between the first and the second outside edges with folded over part sections is substantially larger than with part sections not folded over. The desired material widening is achieved in this manner. It is in particular possible with the invention for the spacing with folded over part sections to be approximately between 1.3 and 4 times as large, in particular approximately between 2 and 3 times as large as with part sections not folded over. A much larger expansion is thus possible with metal elements formed in accordance with the invention by the folding in accordance with the invention than can be achieved, for example, when expanded metal is used.

The apertures advantageously repeat at regular intervals, with this applying both to the apertures formed in the side regions and to any apertures formed in the central region. The apertures can generally also repeat at irregular intervals.

In accordance with a further advantageous embodiment of the invention, the side regions have a substantially planar surface, with the exception of the apertures. The surface of the metal elements is also advantageously planar, with the exception of the apertures. This can be achieved, for example, in that the material thickenings present due to the folding over are rolled flat. A strain hardening thereby additionally occurs at the bending lines and at the folded over part sections rolled thin such that, despite the folding of the material, the stiffness of the folded over sections corresponds at least to the stiffness of the starting material. This is in particular important when the sections formed as webs, for example, are made relatively thin, since in this case a high stiffness of the total metal element is ensured by the strain hardening despite these thin connection positions between the two side regions.

In accordance with a further advantageous embodiment of the invention, the folded over, outwardly disposed part sections include an angle in each case with the central part section of approximately 110° to 0°, preferably from approximately 90° to 0°, advantageously from approximately 45° to 0°, in particular from 10° to 0°. To produce an areal, widened metal element, the outwardly disposed part sections are completely folded over such that they include an angle of approximately 0° with the central part section. It is, however, generally also possible for the folding process not to be carried out up to the complete turning over such that three-dimensional structures can be produced. They can be used, for example, in the production of composite materials, of filters or the like.

In accordance with a further advantageous embodiment of the invention, each of the folded over, outwardly disposed part sections, which is directly connected to a side region, merges continuously, in particular in a planar manner, into the side region connected to it. A smooth or planar surface of the metal element is thereby achieved in this region without edges, bends or the like.

In accordance with a further preferred embodiment of the invention, a respective further metal section adjoins the first and/or the second out-side edges and forms an angular section together with the material extending between the first and the second outside edges. The angular section can in particular be L-shaped, V-shaped, U-shaped, C-shaped or Z-shaped. The areal metal element can easily be used for the forming of a section by this design. The further metal section or metal sections can either have an unbroken surface or, if desired, likewise be interspersed with apertures in accordance with the invention. If, for example, a plaster section should be produced, the angular section is advantageously made in L shape, with both limbs of the section preferably being provided with apertures in accordance with the invention. If the angular section is, in contrast, a holder section, for example, a C-shaped, U-shaped, T-shaped, I-shaped or Z-shaped design is advantageous, with the apertures only being present in the central base part, but not in the outwardly disposed limbs. If required, the apertures can also be formed directly in the bending lines of the angular sections or only in one or more limbs.

The metal element in accordance with the invention can generally be used everywhere where areal metal sections are used, e.g. in all types of open or closed metal sections such as also tubular sections.

The further metal section is, or the further metal sections are, preferably made in one piece with the remaining part of the metal element in order to maintain the one-step manufacturing process in this manner.

In accordance with a further preferred embodiment of the invention, in addition to the first and second side regions, a third and a fourth side region are present which are opposite one another and which each extend transversely, in particular perpendicularly, to the first or second regions. The design of the surface of the material strip corresponds in a direction from the third to the fourth side region substantially to the design of the surface in a direction from the first to the second side region. A material widening is thus not only possible in one direction in this manner, in particular transversely to the longitudinal extent of the metal element, but, for example, in two directions lying perpendicular to one another, for example a direction longitudinally to the longitudinal extent of the metal element and a direction transversely to the longitudinal direction of the metal element. In this embodiment, a two-dimensional expansion and material widening is thus achieved.

The metal element in accordance with the direction can be used in a variety of manners. For example, the metal element can be used as a section element, in particular as a corner section or as a holder section, as a protective grid, as a fence section, as a filter mat, as a soundproofing element, as a plant climbing frame, as a step element, as a reinforcement mat, as an insert in composite materials, as a cable duct, as an aperture band, as a fitting, acoustic or shadowing element or as a decorative section. It is possible in each case for the corresponding elements to be formed completely by the metal element in accordance with the invention or for, as already described, further metal sections to adjoin the metal element containing the apertures.

The invention can generally be used in all areas in which areal materials are perforated, bored or punched in order, for example to achieve a permeability or part permeability or directed reflection for light, sound or fluids. It is achieved with the invention that, differently for example to a perforation, no material waste is created in the production of the apertures and thus costs can be reduced. Further areas of use can be: use in armored glass, sandwich floors, packaging/insulating material, ceiling suspenders, cable carrying systems, metal sheets of catalytic converters, line guiding systems, punched plates, punched strips, installation bands, installation brackets, shelf supports, flat angle connecting strips, roller shutter sections, post supports, section bands, rail systems, slotted bands, strut connectors, support rails or mesh manufacture.

Typical thicknesses of the material strips used in this process lie between approximately 0.3 mm up to 2 mm, in particular between approximately 0.4 mm and 0.8 mm. Aluminum, sheet zinc, stainless steel or galvanized sheet steel can be used as the material, for example. However, the invention is not limited to these thickness values or materials.

Further advantageous embodiments are recited in the dependent claims.

BRIEF DESCRIPTION OF THE DRAWING

The invention will be described in more detail in the following with reference to embodiments and to the Figures; there are shown in these:

FIG. 18 a further cutting pattern;

FIGS. 19-21 three method steps for the manufacture of a metal element formed in accordance with the invention in accordance with the cutting pattern in accordance with FIG. 18;

DETAILED DESCRIPTION OF THE INVENTION

Figure 1:
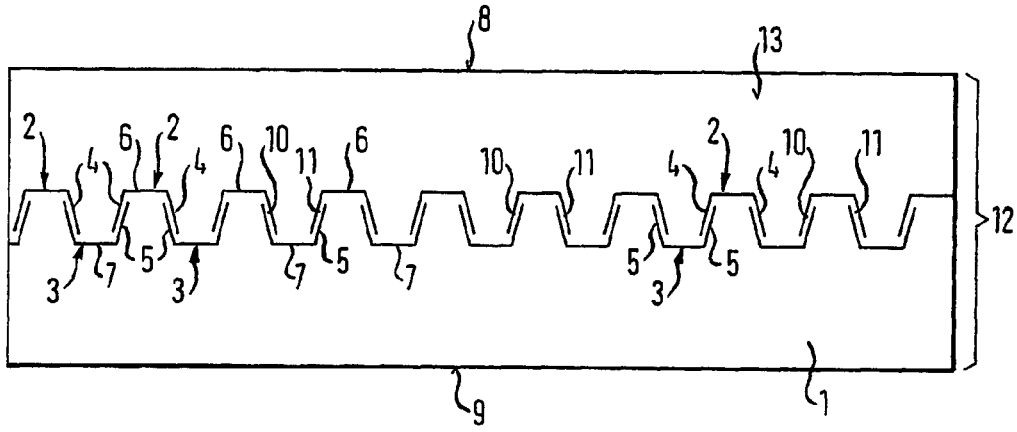
FIG. 1 a cutting pattern with which a metal element in accordance with the invention can be manufactured.

FIG. 1 shows an elongated material strip 1, in particular a metal sheet into which slots 2, 3 extending in meander shape are cut. The slots 2, 3 can be introduced into the material strip 1, for example, by a punching method or by a cutting method (e.g. a rotary cutting method, a laser cutting method) or by another suitable method.

The slots 2, 3 are each made in U shape, with the two limbs 4, 5 running apart from one another toward the open side of the U.

The limbs 4, and also the limbs 5, are each connected to one another by linear base cuts 6, 7 which are each arranged parallel to one another.

The U-shaped slots 2 each lie at the same height, following one another periodically in series along the longitudinal axis of the material strip 1. The U-shaped slots 3 along the longitudinal axis of the material strip 1 lie at equal intervals following one another in series, with the open sides of the U-shaped slots 2 and 3, however, facing toward the respectively other outside edge 8, 9 of the material strip 1. The U-shaped slots 2, 3 are arranged engaging into one another such that the limbs 4, 5 respectively overlap and webs 10, 11 are formed between the limbs 4, 5.

The material strip 1 has a surface 13 with a width 12 which extends from the outside edge 8 to the outside edge 9.

Figure 2:
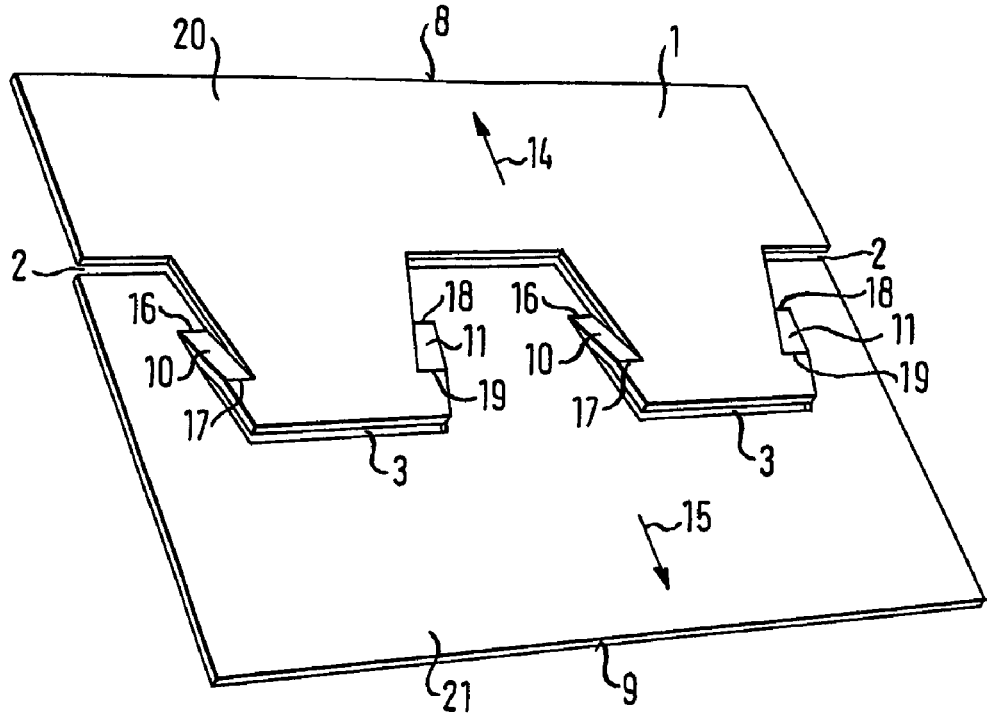
FIGS. 2-4 three different states during the manufacture of a metal element formed in accordance with the invention in accordance with the cutting pattern in accordance with FIG. 1.
Figure 3:
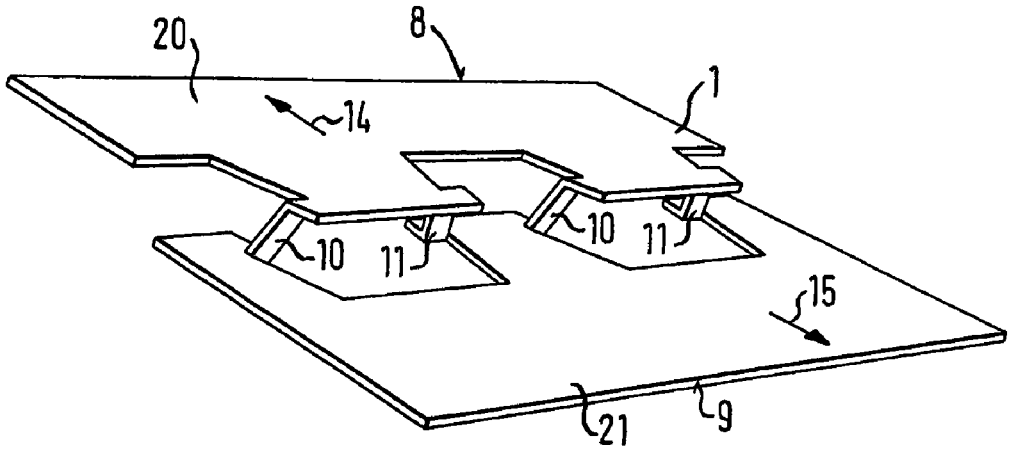
Figure 4:
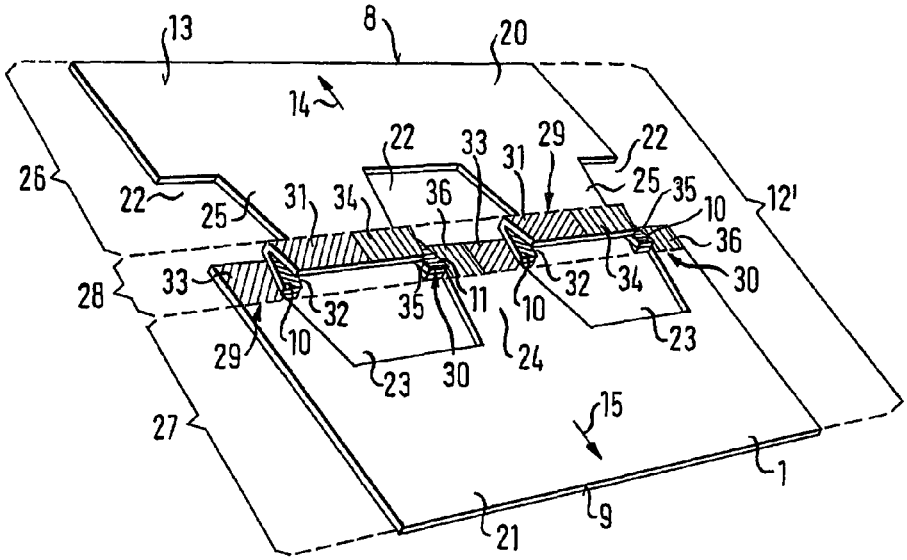

In accordance with FIGS. 2 to 4, a folding process is used for the manufacture of a metal element formed in accordance with the invention using the cutting pattern in accordance with FIG. 1 as a base. For this purpose, the side sections of the material strip 1 are moved apart from one another in opposite directions in accordance with arrows 14, 15 such that the webs 10, 11 are each kinked at two kink lines 16, 17 or 18, 19. On a further pulling apart of the material strip 1 along the arrows 14, 15, the two halves 20, 21 of the material strip 1 connected to one another by the webs 10, 11 move apart from one another until they arrive at the position shown in FIG. 4 after a complete pivoting, where they again substantially lie in the same plane.

After the complete pivoting and the resulting pulling apart from one another of the halves 20, 21 of the material strip 1, apertures 22, 23 are formed in the latter, as can be recognized from FIG. 4. The material filling the apertures 22, 23 prior to the pulling apart forms corresponding lugs 24, 25 which are each connected to one another via two of the webs 10, 11 and are displaced toward one another with respect to the starting state by twice the web length in the direction of pulling apart. The shape of the lugs 24, 25 is complementary to the shape of the apertures 22, 23 with the exception of the web regions.

The width 12 of the material strip 1 has enlarged by twice the web length to the width 12' by the expansion process. Substantially no stretching strains or bending strains occur in the material of the material strip 1 during the expansion procedure or the folding procedure. A bending of the material only takes place directly in the kink lines 16, 17, 18, 19 by the folding over. The material expansion with respect to the surface enlargement is negligible in this process.

In the end position shown in FIG. 4, the material strip 1 has a first side region 26 adjoining the outside edge 8, a second side region 27 adjoining the second outside edge 9 as well as a central region 28 which lies between the two side regions 26, 27 and by which the two side regions 26, 27 are connected to one another.

The central region 28 includes four sections 29, 30 shown by broken lines, with each of these sections 29, 30 consisting of three part sections 31, 32, 33 or 34, 35, 36 respectively. For clarification, the respective outwardly disposed part sections 31, 33 of the section 29 shown in FIG. 4 are hatched in opposite directions obliquely to the central part section 32 lying therebetween. In a similar manner, the outwardly disposed part sections 34 and 36 of the sections 30 are transversely hatched, while the central section 35 lying therebetween is longitudinally hatched with respect to the longitudinal direction of the material strip 1.

As can be recognized from FIG. 4, the respective outwardly disposed part sections 31, 33; 34, 36 are folded over completely in an opposite sense with respect to the central part sections 32, 35 such that the outwardly disposed part sections 31, 34 contact the upper side of the central part sections 32, 35 and the outwardly disposed part sections 33, 36 contact the lower side of the central part sections 32, 35.

It is pointed out in this process that the expression "outwardly disposed" part sections does not necessarily mean that these part sections lie closer to one of the outside edges 8, 9 than the central part sections, but that this expression describes the division of the sections 29, 30 into three part sections, with the "outwardly disposed" part sections in each case being the part sections which are connected to one another by a joint central part section lying between them.

To obtain a surface 13 which is as smooth as possible, the material strip 1 can be guided through a roll apparatus after termination of the folding process. The material, which has three layers in the central region 28, is pressed together by a correspondingly high pressure, with a strain hardening of the material arising at the same time. A largely planar surface 13 is thus produced by the roll procedure, on the one hand, and an increased stability of the material strip 1 is also achieved in the region of the kink lines 16, 17, 18, 19 as well as of the relatively thin webs 10, 11, which form the central part sections 32, 35, on the other hand.

The embodiment shown in FIGS. 5 to 8 substantially corresponds to the embodiment described with respect to FIGS. 1 to 4 so that the same reference numerals are used for the same elements as in FIGS. 1 to 4.

The embodiment in accordance with FIGS. 5 to 8 differs from the embodiment in accordance with FIGS. 1 to 4 only in that two further obliquely extending slots 37, 38 are provided in each case between the U-shaped slots 2, 3. Two webs 10, 10' or 11, 11' respectively arise in each case which lay in series parallel to the expansion direction in accordance with the arrows 14, 15 due to these further slots 37, 38.

The folding procedure takes place identically to the folding procedure described with respect to FIGS. 2 to 4. It is advantageous in the embodiment in accordance with FIGS. 5 to 8 that an even higher stability of the expanded material strip 1 is given by the additional webs 10', 11'.

Figure 8:
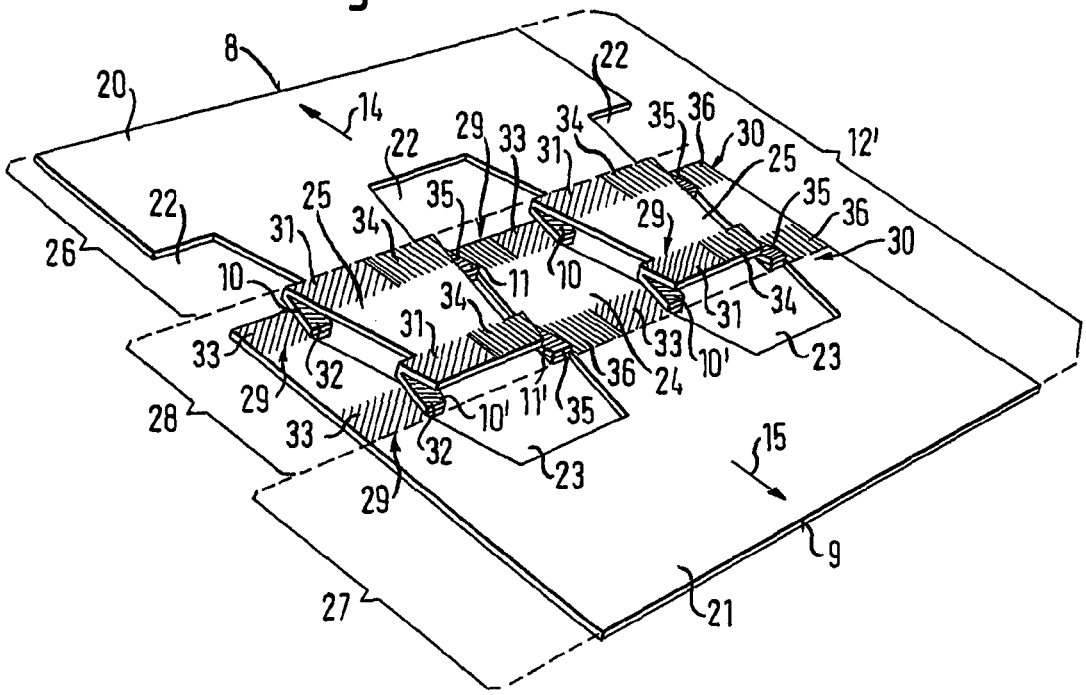

It can furthermore be recognized in FIG. 8 that, on the basis of double the number of webs 10, 10', 11, 11', the central region 28 also has double the number of sections 29, 30 as well as double the number of part sections 31 to 36.

Figure 9:
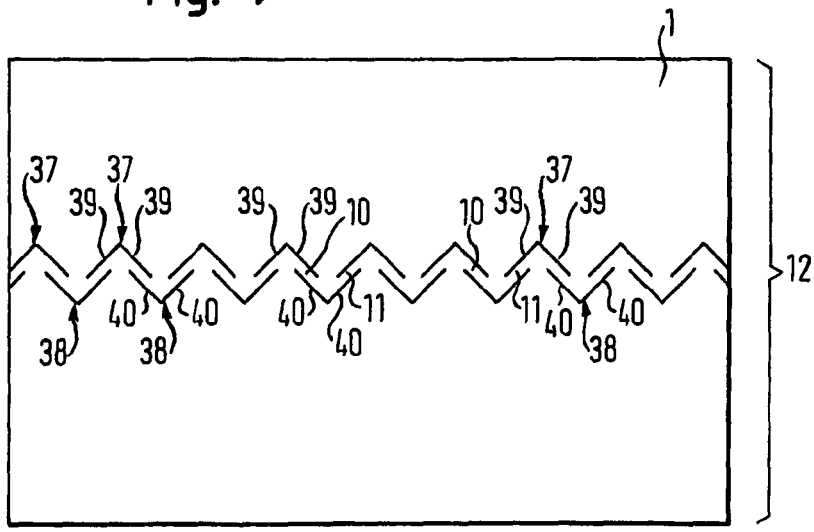
FIG. 9 a further cutting pattern.

FIG. 9 shows an embodiment in which V-shaped slots 37, 38 are cut into the material strip 1 instead of the U-shaped slots 2, 3. Similar to the U-shaped slots 2, 3, the V-shaped slots 37, 38 are also each arranged lying next to one another in the longitudinal direction of the material strip 1 and engaging into one another in an offset manner. The V-shaped slots 37, 38 have limbs 39, 40 which overlap one another such that respective webs 10, 11 are again formed between the limbs 39, 40.

Figure 10:
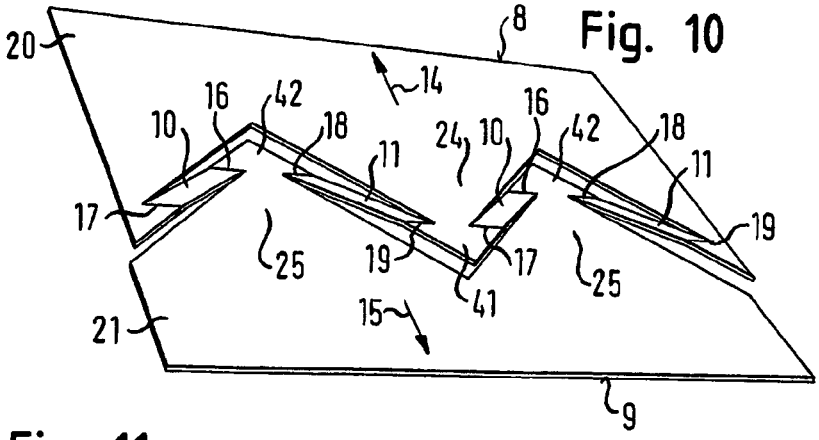
FIGS. 10-12 three method steps for the manufacture of a metal element formed in accordance with the invention in accordance with the cutting pattern in accordance with FIG. 9.
Figure 11:
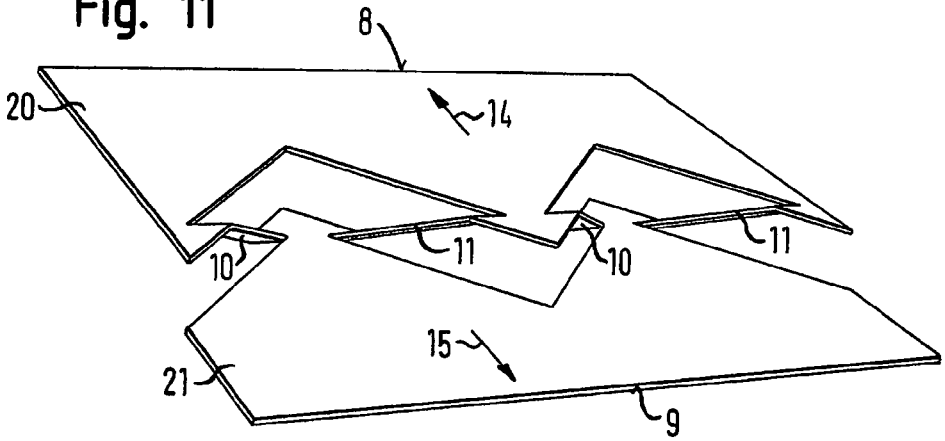
Figure 12:
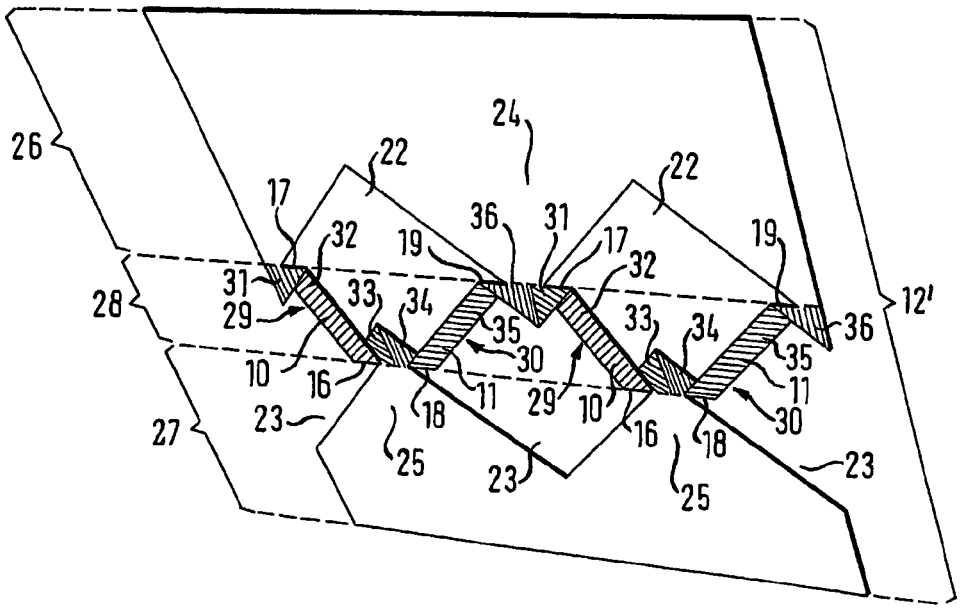

The material strip 1 is moved apart in accordance with FIGS. 10 to 12, in an identical manner as described in FIGS. 2 to 4, along two arrows 14, 15 such that the width 12 of the material strip 1 is expanded to an enlarged width 12' after the end of the folding procedure.

In the folding procedure shown in FIGS. 10 to 12, the webs 10, 11 are folded over as in FIGS. 2 to 4 along the kink lines 16, 17, 18, 19 such that the lugs 24, 25 have triangular tips 41, 42 due to the V-shaped design of the slots 37, 38. Said tips lie in a plane with the lugs 24, 25 in the folding over procedure shown in FIGS. 10 to 12 and respectively form the outwardly disposed part sections 31, 33; 34, 36.

Figure 13:
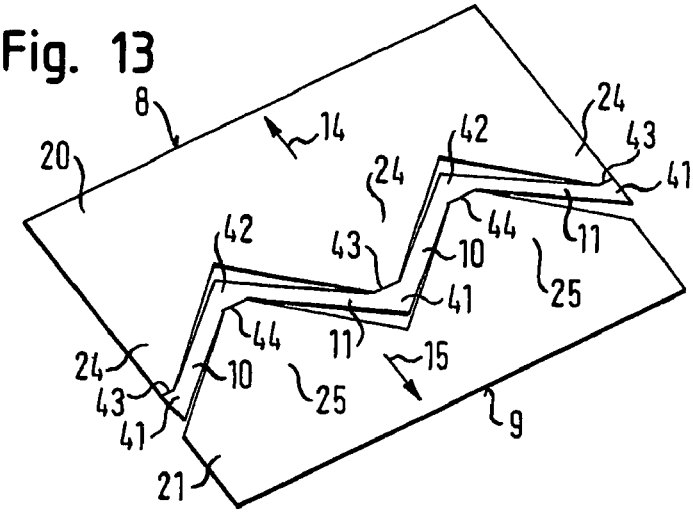
FIGS. 13-15 three alternative method steps in the manufacture of the metal element formed in accordance with the invention in accordance with the cutting pattern in accordance with FIG. 9.
Figure 14:
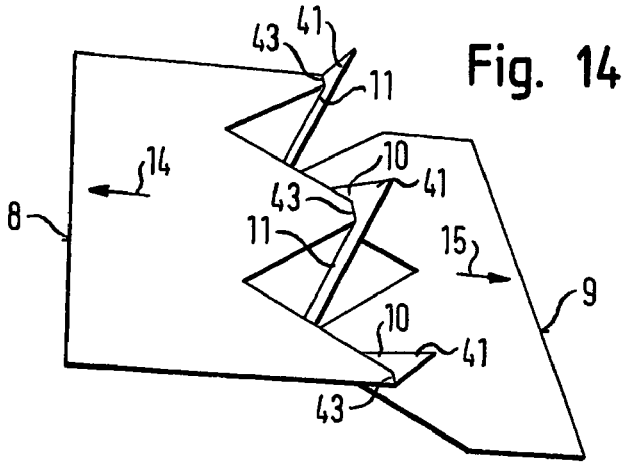
Figure 15:
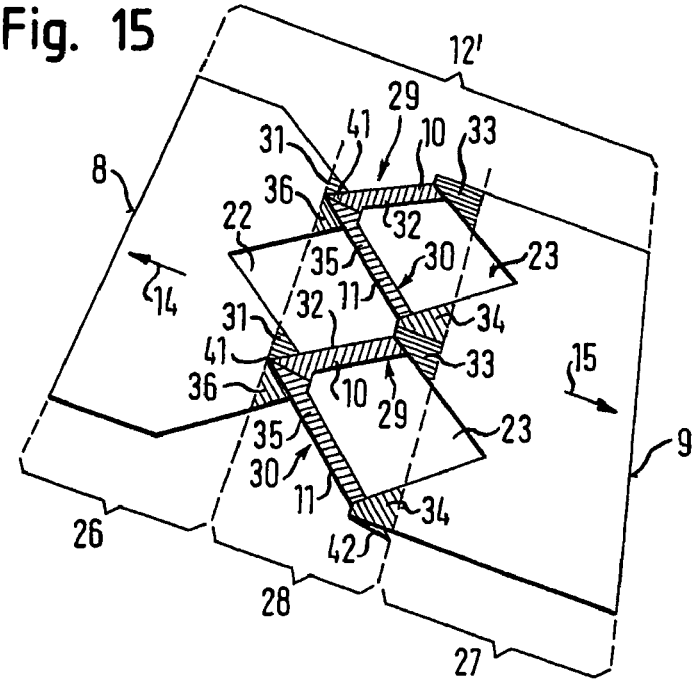

In contrast to this, in the folding procedure shown in FIGS. 13 to 15, the triangular tips 41, 42 are turned over together with the webs 10, 11 along kink lines 43, 44. With the exception of this modified course of the kink lines 43, 44, the folding procedure shown in FIGS. 13 to 15 is identical to the folding procedure shown in FIGS. 10 to 12.

The resulting width 12' of the material strip 1 is identical in both cases; only the number of kink lines 43, 44 is reduced in the folding described with respect to FIGS. 13 to 15.

As already described with respect to the embodiment in accordance with FIGS. 1 to 4, the material strip 1 can also be supplied in the embodiments in accordance with FIGS. 5 to 15, in each case after the complete folding over, to a smoothing apparatus with which the multi-layer material sections are pressed together.

Whereas both in the embodiments in accordance with FIGS. 1 to 4, FIGS. 5 to 8, FIGS. 9 to 12 and also FIGS. 13 to 15, the kink lines have in each case been selected in an identical manner on both sides of the central region 28, it is generally also possible, for example, to select the kink lines on one side of the central region 28 in accordance with the embodiment in accordance with FIGS. 10 to 12 and on the other side of the central region 28 in accordance with the embodiment in accordance with FIGS. 13 to 15. The same also applies to embodiments which do not have V-shaped slots 37, 38, but, for example, U-shaped slots or other slot shapes. In this case, the folded over part sections are thus not folded in opposite senses, but in the same sense.

With respect to the embodiments in accordance with FIGS. 9 to 15, this would mean that on one side of the central region 28, the triangular tips 41 are, as shown in FIG. 12, folded over with respect to the webs 10, 11, whereas the opposite triangular tips 42 form, as shown in FIG. 15, continuous extensions of the webs 10, 11.

In the embodiments in which the bending lines of two adjoining outwardly disposed part sections are separated from one another (see e.g. FIGS. 1-8, 10-12, 19-21), it is also possible for the two mutually adjoining outwardly disposed part sections to be turned over in opposite directions with respect to their respective central part sections. In the embodiment in accordance with FIG. 4, this would e.g. mean that the section 29 is folded as shown, in the section 30, in contrast, the outwardly disposed part section 34 does not lie above the central part section 35, as shown in FIG. 4, but beneath it. The outwardly disposed part section 36 would accordingly not lie beneath the central part section 35, but above it. These different folding directions can occur regularly, for example alternately, or irregularly. The bending stiffness of the metal element can be improved by these sections folded with respect to one another.

The bending stiffness can also be increased in that sequential sections 29, 30 are not only arranged along a straight line over the length of the metal element, in particular in the longitudinal direction of the metal element, but in that at least some sections 29, 30 are arranged laterally offset to one another. While in the embodiment in accordance with FIG. 4, all sections 29, 30 follow one another in a straight line, in the embodiment in accordance with FIG. 8 the sections 29, 30 respectively lying more closely to the outside edge 8 are arranged laterally offset with respect to the sections 29, 30 lying more closely to the outside edge 9 such that the embodiment in accordance with FIG. 8 has a larger bending stiffness than that in accordance with FIG. 4. It would, for example, also be possible in the embodiment in accordance with FIG. 4 to offset the sections 29 laterally in each case with respect to the sections 30 or to offset in each case a pair of sections 29, 30 laterally with respect to the next pair of sections 29, 30 in order to achieve an increased bending stiffness in this manner.

Figure 16:
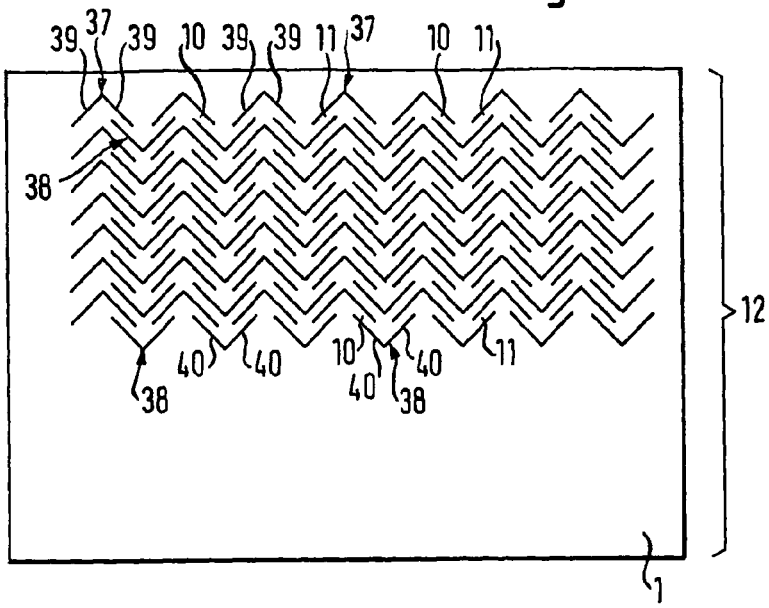
FIG. 16 a further cutting pattern.

FIG. 16 shows the cutting pattern in accordance with FIG. 9, with instead of a single double row of V-shaped slots 37, 38, a plurality of such V-shaped slots engaging into one another being provided.

Figure 17:
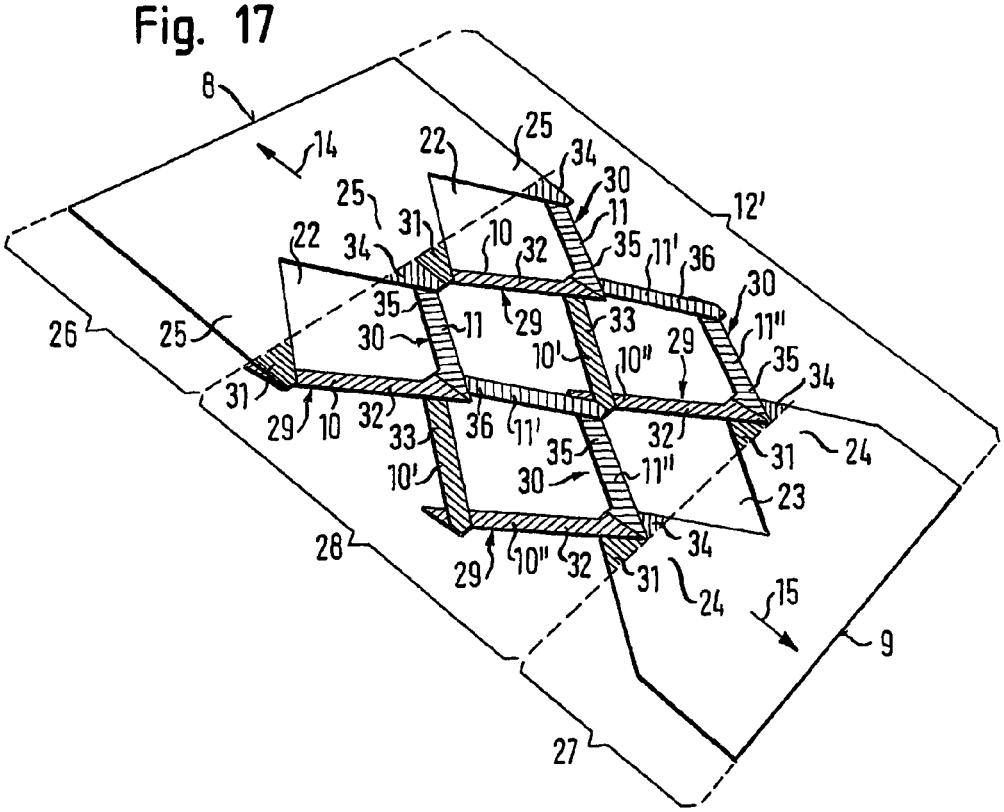
FIG. 17 a metal element formed in accordance with the invention which was manufactured in accordance with the cutting pattern in accordance with FIG. 16.

In such a row arrangement of V-shaped slots 37, 38, ultimately the structure in accordance with the invention shown in FIG. 17 results after the expansion of the material strip, with only a design with two double rows of V-shaped slots 37, 38 next to one another being shown for reasons of simplification.

In a similar manner as described with respect to FIGS. 5 to 8, a plurality of webs lying in series 10, 10', 10, 10" or 11, 11', 11, 11", in this case namely three webs lying in series, result in this process in the expansion direction. It is worthy of mention that in this case the respectively central web 10' or 11' forms a folded over, outwardly disposed part section for the webs 10 and 10" and 11 and 11" respectively forming a central part section.

FIG. 18 shows a cutting pattern which permits an expansion of the material strip 1 both along the arrows 14, 15 and at the same time along arrows 45, 46. A material expansion is thus possible with this cutting pattern not only along one axis, but along two axes standing perpendicular to one another.

Figure 21:
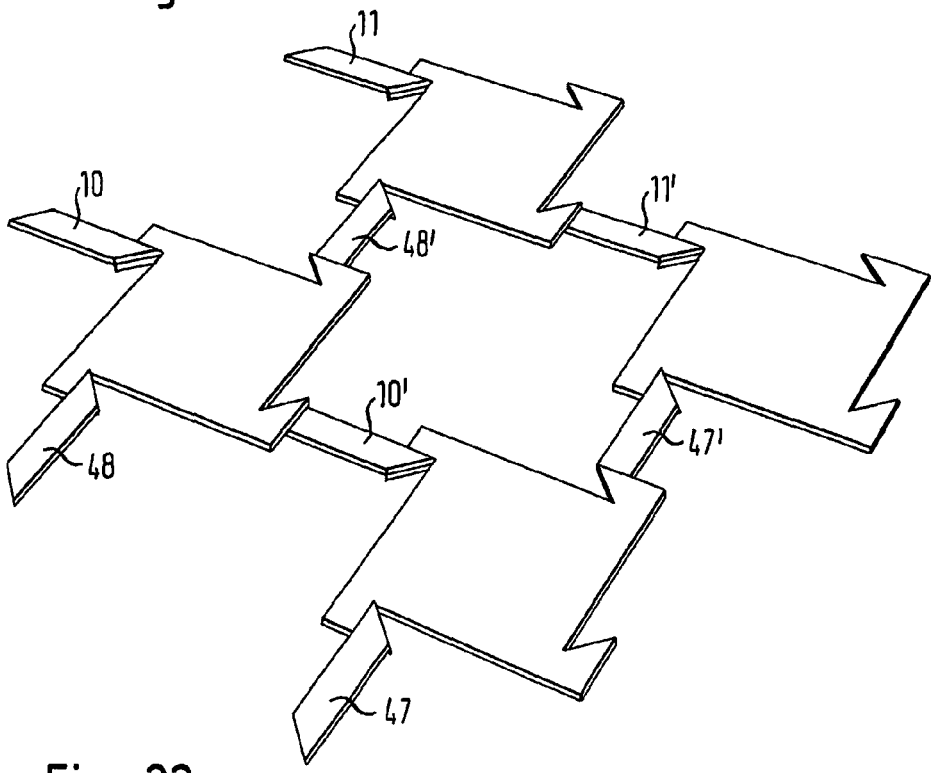

In this case, in addition to webs 10, 10', 11, 11', which extend lying in series between the outside edges 8, 9, webs 47, 47', 48, 48' arranged perpendicular to these webs are furthermore formed, as can be seen from FIGS. 19 to 21. These webs are formed in accordance with the cutting pattern in accordance with FIG. 18 by the overlapping arrangements of slots 49, 50 arranged in a cross-shaped manner.

Figure 5:
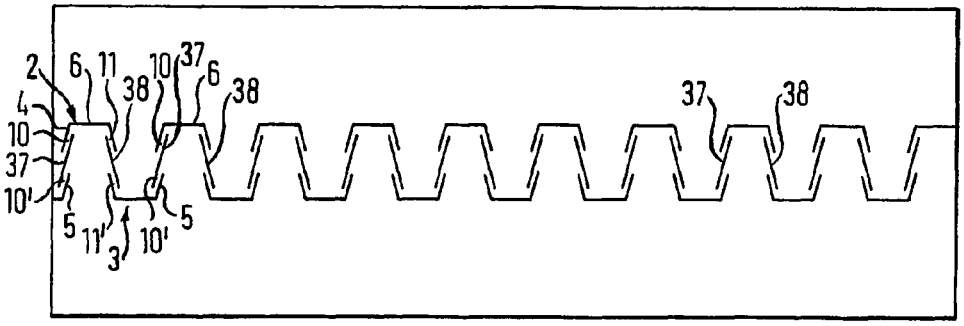
FIG. 5 a further cutting pattern for the manufacture of a metal element formed in accordance with the invention.
Figure 6:
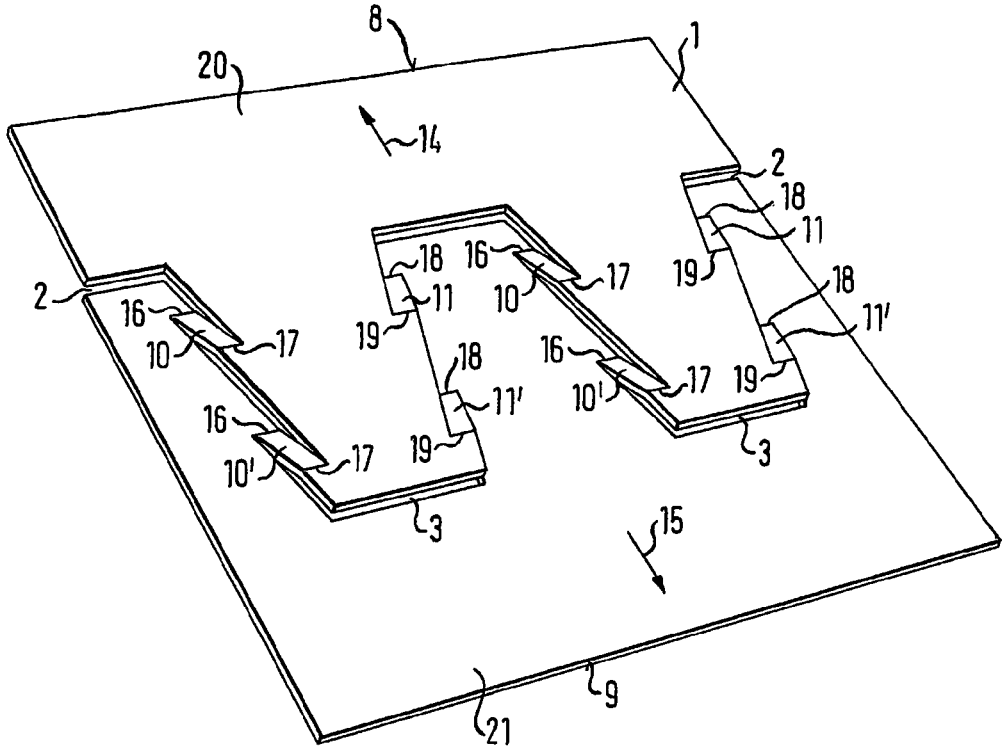
FIGS. 6-8 three method steps for the manufacture of a metal element formed in accordance with the invention in accordance with a cutting pattern in accordance with FIG. 5.
Figure 7:
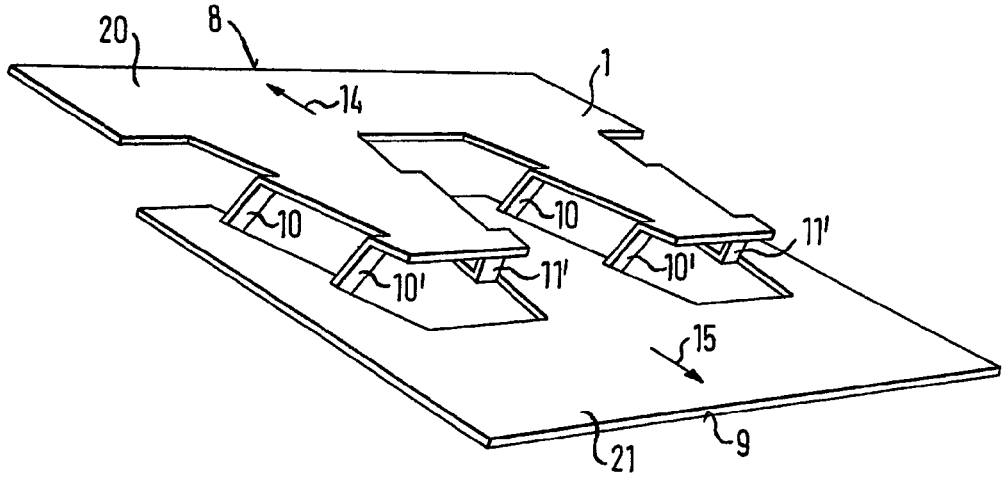
Figure 22:
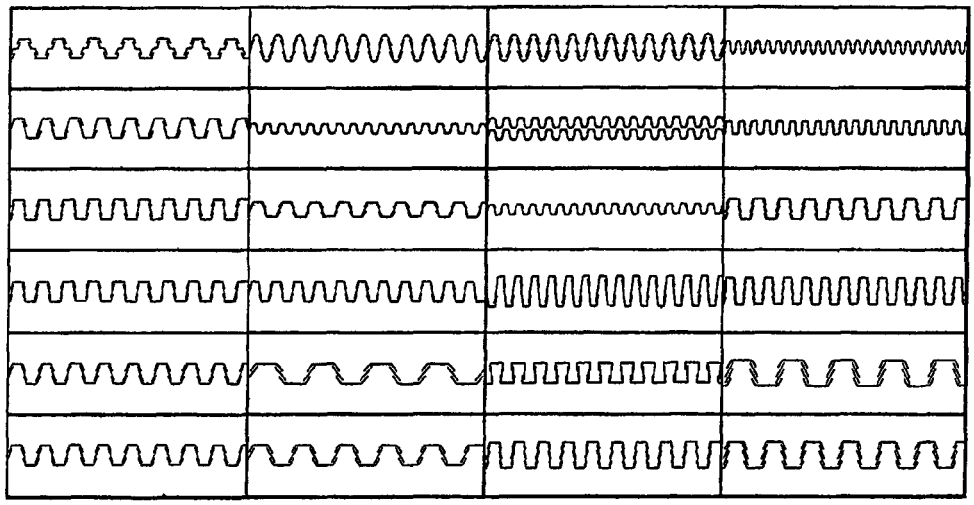
FIG. 22 further variants of different cutting patterns.

Further possible cutting patterns are shown in FIG. 22. In these cutting patterns, as in the already shown cutting patterns, all edges extending toward a tip can, for example, also be replaced by corresponding rounded designs. Furthermore, a multiple staggering such as is shown in FIG. 5, in contrast to in FIG. 1, is also possible with the cutting patterns in accordance with FIG. 22. A parallel arrangement of a plurality of basic patterns parallel to one another as, for example, FIG. 16 shows in comparison to FIG. 9, is possible with the cutting pattern in accordance with FIG. 22.

It is uniform with all cutting patterns that the kink lines created on the folding procedure are always aligned perpendicular to the expansion direction.

Figure 23:
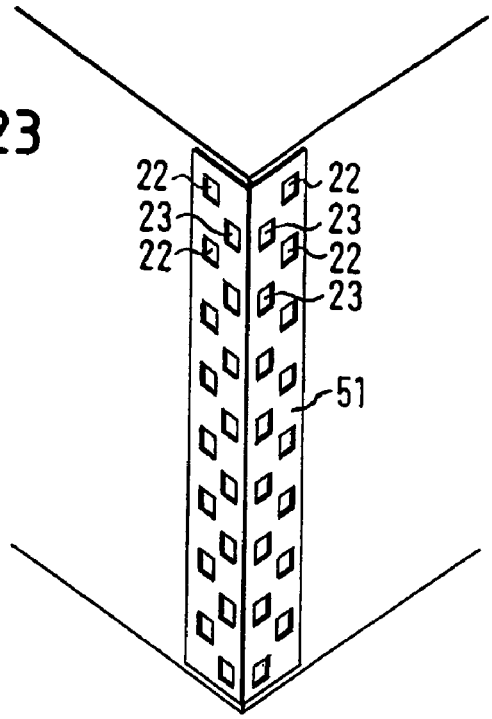
FIG. 23 a schematic representation of a corner section in accordance with the invention.
Figure 24:
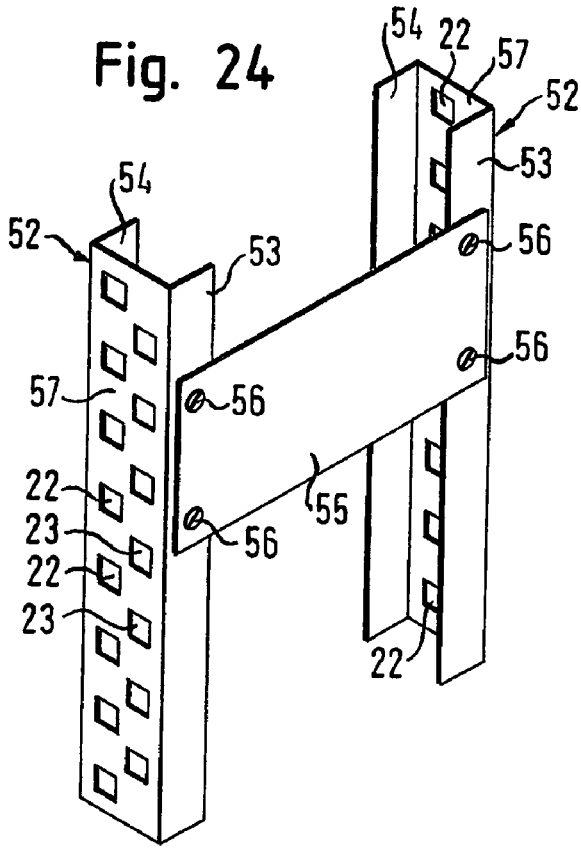
FIG. 24 a schematic representation of a holder section formed in accordance with the invention.

Finally, in FIGS. 23 and 24, a further two application examples of the invention are shown.

FIG. 23 shows schematically a corner section 51 such as is used as a plaster section. The corner section 51 in this process is formed as an L-shaped angular section, with both limbs of the angular corner section 51 being provided with apertures 22, 23 in accordance with the invention. It is ensured by the apertures 22, 23 that the plaster used for the plastering of the corner section 51 can pass through the corner section 51 and a secure fastening of the corner section 51 is thus ensured.

By the forming of the corner section 51 in accordance with the invention by means of a metal element expanded in accordance with the invention, at the same time the material requirement for the production of the corner section is reduced and the required stiffness of the corner section is ensured.

FIG. 24 shows two holder sections 52 which are each formed as C-shaped angular sections. While the two limbs 53, 54, to which a plate 55 is fastened, for example, by screws 56, are formed in the usual manner as solid material, the two base sections 57 of the holder sections 52 are manufactured as metal elements formed in accordance with the invention and are provided with the corresponding apertures 22, 23. It is ensured in this manner that the material consumption for the manufacture of the holder sections 53 is substantially reduced with respect to conventional methods.

REFERENCE NUMERAL LIST

1 material strip
2 slots
3 slots
4 limb
5 limb
6 base cuts
7 base cuts
8 outside edge
9 outside edge
10, 10' webs
11, 11' webs
12, 12' width
13 surface
14 arrow
15 arrow
16 kink line
17 kink line
18 kink line
19 kink line
20 half of the material strip 1
21 half of the material strip 1
22 apertures
23 apertures
24 lugs
25 lugs
26 side region
27 side region
28 central region
29 sections
30 sections
31 outwardly disposed part sections
32 central part sections
33 outwardly disposed part sections
34 outwardly disposed part sections
35 central part sections
36 outwardly disposed part sections
37 V-shaped slots
38 V-shaped slots
39 limb
40 limb
41 triangular tip
42 triangular tip
43 kink line
44 kink line
45 arrow
46 arrow
47, 47' webs
48, 48' webs
49 slots
50 slots
51 corner section
52 holder section
53 limb
54 limb
55 plate
56 screws
57 base section

The invention claimed is:

1. An areal metal element having a surface (13) which extends from a first outside edge (8) to a second outside edge (9) lying opposite the first outside edge (8), with the region of the metal element adjoining the first outside edge (8) forming a first side region (26) and the region of the metal element adjoining the second outer edge (9) forming a second side region (27), both said side regions being connected to one another by a central region (28) lying between them, and with at least one completely bordered aperture (22, 23) being formed in at least one of the side regions (26, 27), with its border being formed in one part by said side region (26, 27) and in the other part by the central region (28), with the central region (28) including at least two sections (29, 30) which each consist of two outwardly disposed part sections (31, 33, 34, 36) and a central part section (32, 35) lying between them, with the outwardly disposed part sections (31, 33, 34, 36) being folded over with respect to the central part section (32, 35) for the production of the aperture (22, 23); with the sections (29, 30) forming part of the border of the aperture (22, 23); and with the central region (28), including the sections (29, 30), being made in one piece with the two side regions (26, 27) of the metal element, characterized in that, in the central region (28), at least one further section (29, 30) is formed for each section (29; 30) and is associated with and of the same type as this section (29; 30), with the sections (29, 29; 30, 30) associated with one another being arranged sequentially in a direction from the first side region (26) to the second side region (27) and with each of the two outwardly disposed part sections (31, 33, 34, 36) of one of these sections (29, 30) being directly connected to the respective corresponding outwardly disposed part section (31, 33; 34, 36) of the other section (29, 30) by an areal region (24, 25) of the metal element.

2. A metal element in accordance with claim 1, characterized in that at least some of the outwardly disposed part sections (31, 33, 34, 36) are folded over in opposite senses to one another, i.e., in directions opposite to one another.

3. A metal element in accordance with claim 2, characterized in that one of the outwardly disposed part sections (31, 34) is folded over toward the upper side of the central part section (32, 35) and the other outwardly disposed part section (33, 36) is folded over toward the lower side of the central part section (32, 35).

4. A metal element in accordance with claim 1, characterized in that at least some of the outwardly disposed part sections are folded over in the same sense with respect to one another, i.e., extending in the same direction.

5. A metal element in accordance with claim 4, characterized in that both outwardly disposed part sections are folded over toward the same side, i.e., either both toward the upper side or both toward the lower side of the central part section.

6. A metal element in accordance with claim 1, characterized in that a plurality of apertures (22, 23) are formed at least in one of the side regions (26, 27).

7. A metal element in accordance with claim 6, characterized in that a plurality of apertures (22, 23) are formed in each of the side regions (26, 27).

8. A metal element in accordance with claim 1, characterized in that additional apertures are formed in the central region (28).

9. A metal element in accordance with claim 8, characterized in that the apertures formed in the central region (28) are formed in correspondence with the apertures (22, 23) formed in the side regions (26, 27).

10. A metal element in accordance with claim 1, characterized in that a section (29, 30) is formed as a web (10, 10', 10", 11, 11', 11") with side edges extending parallel to one another.

11. A metal element in accordance with claim 1, characterized in that the side edges of different webs (10, 10', 10", 11, 11', 11") extend parallel to one another or obliquely to one another.

12. A metal element in accordance with claim 1, characterized in that the spacing (12, 12') between the first and the second outside edges (8, 9) with folded over part sections (31, 33; 34, 36) is substantially larger than with non-folded over part sections (31, 33; 34, 36).

13. A metal element in accordance with claim 12, characterized in that the spacing (12') with folded over part sections (31, 33, 34, 36) is approximately between 1.3 and 4 times as large as the spacing (12) with non-folded over part sections (31, 33, 34, 36).

14. A metal element in accordance with claim 1, characterized in that the apertures (22, 23) repeat at regular intervals.

15. A metal element in accordance with claim 1, characterized in that the material of the metal element is substantially unexpanded, i.e., no stretching of the material takes place for the production of the aperture.

16. A metal element in accordance with claim 1, characterized in that the side regions (26, 27) have a substantially planar surface (13) with the exception of the apertures (22, 23).

17. A metal element in accordance with claim 1, characterized in that the surface (13) of the metal element is substantially planar with the exception of the apertures (22, 23).

18. A metal element in accordance with claim 1, characterized in that the folded over, outwardly disposed part sections (31, 33; 34, 36) each include an angle with the central part section (32, 35) of approximately 110° to 0°.

19. A metal element in accordance with claim 1, characterized in that each of the folded over, outwardly disposed part sections (31, 33, 34, 36), which is directly connected to a side region (26, 27), merges continuously into the side region (26, 27) connected to it.

20. A metal element in accordance with claim 1, characterized in that a further metal section (53, 54) respectively adjoins the first and/or the second outside edge (8, 9) and forms an angular section (51, 52) together with the material extending between the first and the second outside edges (8, 9).

21. A metal element in accordance with claim 20, characterized in that the angular section (51, 52) is L-shaped, V-shaped, U-shaped, C-shaped, T-shaped, I-shaped or Z-shaped.

22. A metal element in accordance with claim 20, characterized in that the further metal section (53, 54) or the further metal sections is/are formed in one piece with the remaining part of the metal element.

23. A metal element in accordance with claim 1, characterized in that in addition to the first and second side regions (26, 27), a third and a fourth side region are present which lie opposite one another and respectively extend transversely to the first and second side regions (26, 27); and in that the design of the surface (13) in a direction from the third side region to the fourth side region substantially corresponds to the design of the surface (13) in a direction from the first side region to the second side region (26, 27).

24. A metal element in accordance with claim 1, characterized in that to increase the bending stiffness over the length of the metal element, sequential sections (29, 30) are not only arranged along a straight line but in that at least some sections (29, 30) are arranged laterally off-set to one another.

25. A metal element in accordance with claim 3, characterized in that the apertures formed in the central region (28) are formed in correspondence with the apertures (22, 23) formed in the side regions (26, 27).

26. An areal metal element having a surface (13) which extends from a first outside edge (8) to a second outside edge (9) lying opposite the first outside edge (8), with the region of the metal element adjoining the first outside edge (8) forming a first side region (26) and the region of the metal element adjoining the second outer edge (9) forming a second side region (27), both said side regions being connected to one another by a central region (28) lying between them, and with at least one completely bordered aperture (22, 23) being formed in at least one of the side regions (26, 27), with its border being formed in one part by said side region (26, 27) and in the other part by the central region (28), with the central region (28) including at least two sections (29, 30) which each consist of two outwardly disposed part sections (31, 33, 34, 36) and a central part section (32, 35) lying between them, with the outwardly disposed part sections (31, 33, 34, 36) being folded over with respect to the central part section (32, 35) for the production of the aperture (22, 23); with the sections (29, 30) forming part of the border of the aperture (22, 23); and with the central region (28), including the sections (29, 30), being made in one piece with the two side regions (26, 27) of the metal element, characterized in that two folding edges (16, 17; 18, 19) are provided which are formed by the folding over of the outwardly disposed sections (31, 33, 34, 36) with respect to the central part section (32, 35) and of which the folding edge (17; 19) disposed more closely to the first outer edge (8) of the metal element points in the direction of the first outer edge (8) and the folding edge (16; 18) disposed more closely to the second outer edge (9) of the metal element points in the opposite way thereto in the direction of the second outer edge (9).

27. A metal element in accordance with claim 26, characterized in that at least some of the outwardly disposed part sections (31, 33, 34, 36) are folded over in opposite senses to one another, i.e., in directions opposite to one another.

28. A metal element in accordance with claim 27, characterized in that one of the outwardly disposed part sections (31, 34) is folded over toward the upper side of the central part section (32, 35) and the other outwardly disposed part section (33,36) is folded over toward the lower side of the central part section (32, 35).

29. A metal element in accordance with claim 26, characterized in that at least some of the outwardly disposed part sections are folded over in the same sense with respect to one another, i.e., extending in the same direction.

30. A metal element in accordance with claim 29, characterized in that both outwardly disposed part sections are folded over toward the same side, i.e., either both toward the upper side or both toward the lower side of the central part section.

31. A metal element in accordance with claim 26, characterized in that a plurality of apertures (22, 23) are formed at least in one of the side regions (26, 27).

32. A metal element in accordance with claim 31, characterized in that a plurality of apertures (22, 23) are formed in each of the side regions (26, 27).

33. A metal element in accordance with claim 26, characterized in that additional apertures are formed in the central region (28).

34. A metal element in accordance with claim 26, characterized in that a section (29, 30) is formed as a web (10, 10', 10", 11, 11', 11") with side edges extending parallel to one another.

35. A metal element in accordance with claim 26, characterized in that the side edges of different webs (10, 10', 10", 11, 11', 11") extend parallel to one another or obliquely to one another.

36. A metal element in accordance with claim 26, characterized in that the spacing (12, 12') between the first and the second outside edges (8, 9) with folded over part sections (31, 33; 34, 36) is substantially larger than with non-folded over part sections (31, 33; 34, 36).

37. A metal element in accordance with claim 36, characterized in that the spacing (12') with folded over part sections (31, 33, 34, 36) is approximately between 1.3 and 4 times as large as the spacing (12) with non-folded over part sections (31, 33, 34, 36).

38. A metal element in accordance with claim 26, characterized in that the apertures (22, 23) repeat at regular intervals.

39. A metal element in accordance with claim 26, characterized in that the material of the metal element is substantially unexpanded, i.e., no stretching of the material takes place for the production of the aperture.

40. A metal element in accordance with claim 26, characterized in that the side regions (26, 27) have a substantially planar surface (13) with the exception of the apertures (22, 23).

41. A metal element in accordance with claim 26, characterized in that the surface (13) of the metal element is substantially planar with the exception of the apertures (22, 23).

42. A metal element in accordance with claim 26, characterized in that the folded over, outwardly disposed part sections (31, 33; 34, 36) each include an angle with the central part section (32, 35) of approximately 110° to 0°.

43. A metal element in accordance with claim 26, characterized in that each of the folded over, outwardly disposed part sections (31, 33, 34, 36), which is directly connected to a side region (26, 27), merges continuously into the side region (26, 27) connected to it.

44. A metal element in accordance with claim 26, characterized in that a further metal section (53, 54) respectively adjoins the first and/or the second outside edge (8, 9) and forms an angular section (51, 52) together with the material extending between the first and the second outside edges (8, 9).

45. A metal element in accordance with claim 44, characterized in that the angular section (51, 52) is L-shaped, V-shaped, U-shaped, C-shaped, T-shaped, I-shaped or Z-shaped.

46. A metal element in accordance with claim 44, characterized in that the further metal section (53, 54) or the further metal sections is/are formed in one piece with the remaining part of the metal element.

47. A metal element in accordance with claim 26, characterized in that in addition to the first and second side regions (26, 27), a third and a fourth side region are present which lie opposite one another and respectively extend transversely; and in that the design of the surface (13) in a direction from the third side region to the fourth side region substantially corresponds to the design of the surface (13) in a direction from the first side region to the second side region (26, 27).

48. A metal element in accordance with claim 26, characterized in that to increase the bending stiffness over the length of the metal element, sequential sections (29, 30) are not only arranged along a straight line, but in that at least some sections (29, 30) are arranged laterally offset to one another.

49. A method of manufacturing a metal element having a surface (13) which extends from a first outside edge (8) to a second outside edge (9) lying opposite the first outside edge (8), with the region of the metal element adjoining the first outside edge (8) forming a first side region (26) and the region of the metal element adjoining the second outer edge (9) forming a second side region (27), both said side regions being connected to one another by a central region (28) lying between them, and with at least one completely bordered aperture (22, 23) being formed in at least one of the side regions (26, 27), with its border being formed in one part by said side region (26, 27) and in the other part by the central region (28), with the central region (28) including at least two sections (29, 30) which each consist of two outwardly disposed part sections (31, 33, 34, 36) and a central part section (32, 35) lying between them, with the outwardly disposed part sections (31, 33, 34, 36) being folded over with respect to the central part section (32, 35) for the production of the aperture (22, 23); with the sections (29, 30) forming part of the border of the aperture (22, 23); and with the central region (28), including the sections (29, 30), being made in one piece with the two side regions (26, 27) of the metal element, wherein, in the central region (28), at least one further section (29, 30) is formed for each section (29; 30) and is associated with and of the same type as this section (29; 30), with the sections (29, 29; 30, 30) associated with one another being arranged sequentially in a direction from the first side region (26) to the second side region (27) and with each of the two outwardly disposed part sections (31, 33, 34, 36) of one of these sections (29, 30) being directly connected to the respective corresponding outwardly disposed part section (31, 33; 34, 36) of the other section (29, 30) by an areal region (24, 25) of the metal element and wherein, in said method, a material web (1) is provided with cuts (2, 3, 37, 38) in accordance with a pre-determined cut pattern for the production of the sections (29, 30) and the respective outwardly disposed part sections (31, 33, 34, 36) are folded over with respect to the central part section (32, 35) for the production of an aperture (22, 23), characterized in that, for the folding over of the outwardly disposed part sections (31, 33, 34, 36) with respect to the central part section (32, 35), the side regions (26, 27) of the metal element are moved apart from one another in opposite directions in a pivot movement until they lie substantially in the same plane after a complete pivoting.

50. A method in accordance with claim 49, characterized in that the metal element is guided through a roll apparatus after the folding over of the metal element.

51. A method in accordance with claim 50, characterized in that a strain hardening of the material web takes place.

52. A method of manufacturing a metal element having a surface (13) which extends from a first outside edge (8) to a second outside edge (9) lying opposite the first outside edge (8), with the region of the metal element adjoining the first outside edge (8) forming a first side region (26) and the region of the metal element adjoining the second outer edge (9) forming a second side region (27), both said side regions being connected to one another by a central region (28) lying between them, and with at least one completely bordered aperture (22, 23) being formed in at least one of the side regions (26, 27), with its border being formed in one part by said side region (26, 27) and in the other part by the central region (28), with the central region (28) including at least two sections (29, 30) in which each consist of two outwardly disposed part sections (31, 3, 34, 36) and a central part section (32, 35) lying between them, with the outwardly disposed part sections (31, 33, 34, 36) being folded over with respect to the central part section (32, 35) for the production of the aperture (22, 23); with the sections (29, 30) forming part of the border of the aperture (22, 23); and with the central region (28), including the sections (29, 30), being made in one piece with the two side regions (26, 27) of the metal element, wherein two folding edges (16, 17; 18, 19) are provided which are formed by the folding over of the outwardly disposed sections (31, 33, 34, 36) with respect to the central part section (32, 35) and of which the folding edge (17; 19) disposed more closely to the first outer edge (8) of the metal element points in the direction of the first outer edge (8) and the folding edge (16; 18) disposed more closely to the second outer edge (9) of the metal element points in the opposite way thereto in the direction of the second outer edge (9) and wherein, in said method, a material web (1) is provided with cuts (2, 3, 37, 38) in accordance with a predetermined cut pattern for the production of the sections (29, 30) and the respective outwardly disposed part sections (31, 33, 34, 36) are folded over with respect to the central part section (32, 35) for the production of an aperture (22, 23), characterized in that, for the folding over of the outwardly disposed part sections (31, 33, 34, 36) with respect to the central part section (32, 35), the side regions (26, 27) of the metal element are moved apart from one another in opposite directions in a pivot movement until they lie substantially in the same plane after a complete pivoting.

53. A method in accordance with claim 52, characterized in that the metal element is guided through a roll apparatus after the folding over of the metal element.

54. A method in accordance with claim 53, characterized in that a strain hardening of the material web takes place.

55. A method of manufacturing a metal element having a surface (13) which extends from a first outside edge (8) to a second outside edge (9) lying opposite the first outside edge (8), with the region of the metal element adjoining the first outside edge (8) forming a first side region (26) and the region of the metal element adjoining the second outer edge (9) forming a second side region (27), both said side regions being connected to one another by a central region (28) lying between them, and with at least one completely bordered aperture (22, 23) being formed in at least one of the side regions (26, 27), with its border being formed in one part by said side region (26, 27) and in the other part by the central region (28), with the central region (28) including at least two sections (29, 30) which each consist of two outwardly disposed part sections (31, 33, 34, 36) and a central part section (32, 35) lying between them, with the outwardly disposed part sections (31, 33, 34, 36) being folded over with respect to the central part section (32, 35) for the production of the aperture (22, 23); with the sections (29, 30) forming part of the border of the aperture (22, 23); and with the central region (28), including the sections (29, 30), being made in one piece with the two side regions (26, 27) of the metal element, wherein, in the central region (28), at least one further section (29, 30) is formed for each section (29; 30) and is associated with and of the same type as this section (29; 30), with the sections (29, 29; 30, 30) associated with one another being arranged sequentially in a direction from the first side region (26) to the second side region (27) and with each of the two outwardly disposed part sections (31, 33, 34, 36) of one of these sections (29, 30) being directly connected to the respective corresponding outwardly disposed part section (31, 33; 34, 36) of the other section (29, 30) by an areal region (24, 25) of the metal element and wherein, in said method, a material web (1) is provided with cuts (2, 3, 37, 38) in accordance with a pre-determined cut pattern for the production of the sections (29, 30) and the respective outwardly disposed part sections (31, 33, 34, 36) are folded over with respect to the central part section (32, 35) for the production of an aperture (22, 23), characterized in that the cuts (2, 3, 37, 38) in the material web (1) are produced by a rotary cutting method or a laser cutting method.

56. A method in accordance with claim 55, characterized in that the metal element is guided through a roll apparatus after the folding over of the metal element.

57. A method in accordance with claim 56, characterized in that a strain hardening of the material web takes place.

58. A method of manufacturing a metal element having a surface (13) which extends from a first outside edge (8) to a second outside edge (9) lying opposite the first outside edge (8), with the region of the metal element adjoining the first outside edge (8) forming a first side region (26) and the region of the metal element adjoining the second outer edge (9) forming a second side region (27), both said side regions being connected to one another by a central region (28) lying between them, and with at least one completely bordered aperture (22, 23) being formed in at least one of the side regions (26, 27), with its border being formed in one part by said side region (26, 27) and in the other part by the central region (28), with the central region (28) including at least two sections (29, 30) which each consist of two outwardly disposed part sections (31, 33, 34, 36) and a central part section (32, 35) lying between them, with the outwardly disposed part sections (31, 33, 34, 36) being folded over with respect to the central part section (32, 35) for the production of the aperture (22, 23); with the sections (29, 30) forming part of the border of the aperture (22, 23); and with the central region (28), including the sections (29, 30), being made in one piece with the two side regions (26, 27) of the metal element, wherein two folding edges (16, 17; 18, 19) are provided which are formed by the folding over of the outwardly disposed sections (31, 33, 34, 36) with respect to the central part section (32, 35) and of which the folding edge (17; 19) disposed more closely to the first outer edge (8) of the metal element points in the direction of the first outer edge (8) and the folding edge (16; 18) disposed more closely to the second outer edge (9) of the metal element points in the opposite way thereto in the direction of the second outer edge (9), and wherein, in said method, a material web (1) is provided with cuts (2, 3, 37, 38) in accordance with a predetermined cut pattern for the production of the sections (29, 30) and the respective outwardly disposed part sections (31, 33, 34, 36) are folded over with respect to the central part section (32, 35) for the production of an aperture (22, 23), characterized in that the cuts (2, 3, 37, 38) in the material web (1) are produced by a rotary cutting method or a laser cutting method.

59. A method in accordance with claim 58, characterized in that the metal element is guided through a roll apparatus after the folding over of the metal element.

60. A method in accordance with claim 59, characterized in that a strain hardening of the material web takes place.

* * * * *